United States Patent [19]

Haubrich

[11] 4,358,083

[45] Nov. 9, 1982

[54] PLASTIC BAG HOLDER

[76] Inventor: Raymond O. Haubrich, 1089 Forest Ave., DesPlaines, Ill. 60018

[21] Appl. No.: 212,981

[22] Filed: Dec. 4, 1980

[51] Int. Cl.[3] ..... B65B 67/04

[52] U.S. Cl. ..... 248/545; 248/100; 248/156

[58] Field of Search ..... 248/95, 97, 98, 99, 248/100, 101, 146, 156, 545; 141/391; 53/390

[56] References Cited

U.S. PATENT DOCUMENTS

| | | | |
|---|---|---|---|
| 2,235,182 | 3/1941 | Weston | 248/100 |
| 2,401,969 | 6/1946 | Schlank | 248/101 X |
| 2,556,124 | 6/1951 | Ullrich | 248/156 X |
| 3,041,026 | 6/1962 | Wilson | 248/100 X |
| 3,313,504 | 4/1967 | Stoltze | 248/99 |
| 3,679,160 | 7/1972 | Ballenger | 248/101 X |
| 3,756,548 | 9/1973 | Santarelli | 248/99 X |
| 3,773,286 | 11/1973 | Govani | 248/156 X |
| 3,796,402 | 3/1974 | Trotta | 248/156 X |
| 4,196,880 | 4/1980 | Hynes | 248/95 X |

FOREIGN PATENT DOCUMENTS

| | | | |
|---|---|---|---|
| 6407850 | 1/1966 | Netherlands | 248/99 |

*Primary Examiner*—J. Franklin Foss

*Attorney, Agent, or Firm*—Hill, Van Santen, Steadman, Chiara & Simpson

[57] ABSTRACT

A plastic bag holder formed with ground engaging feet that can be inserted into the ground with a foot rest and which has a vertically and size adjustable hoop over which the bag can be placed and pulled over so as to lock the bag to the device with a plurality of extensions. T-shaped members are moveable mounted on a cross bar for adjusting the size of the hoop.

8 Claims, 6 Drawing Figures

PLASTIC BAG HOLDER

BACKGROUND OF THE INVENTION

1. Field of the Invention

This invention relates in general to holding means and particular to an adjustable bag holder which can be inserted into the ground so as to support and hold a bag open.

2. Description of the Prior Art

It is very difficult for one person to place articles such as leaves into bags and it is desirable to have one person hold the bag open while the other places the leaves or other items into and bag.

SUMMARY OF THE INVENTION

The present invention provides an adjustable bag holder which has prongs that can be inserted into the ground to insert an adjustable hoop or ring formed with bag engaging holding means over which the mouth of a bag can be stretched such that the bag holder holds the mouth open so that the bag can be filled. The adjustable hoop is mounted on a transverse pair of slide members that fit on a support such that the slide members can be horizontally adjusted to provide a ring of different sizes to adapt to different size bag openings. The invention makes it possible for one person to mount the bag on the bag holder and fill it in a rapid and efficient manner.

A foot rest is provided for inserting the holder into the ground and one side of the foot rest may be loosened so as to insert a roll of stored bags onto the holder where they can be conveniently stored and removed.

Other objects, features and advantages of the invention will be readily apparent from the following description of certain preferred embodiments thereof taken in conjunction with the accompanying drawings although variations and modifications may be effected without departing from the spirit and scope and the novel concepts of the disclosure and in which:

DESCRIPTION OF THE PREFERRED EMBODIMENTS

Figure 1:
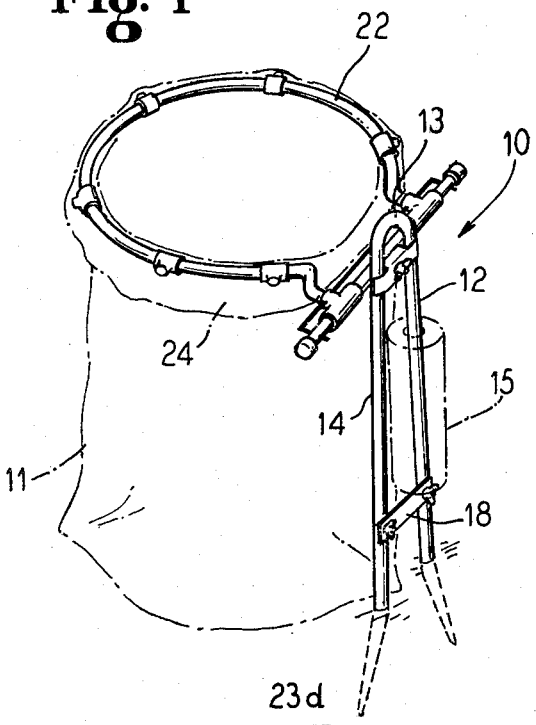
FIG. 1 is a perspective view of the bag holder with a bag mounted thereon.
Figure 4:
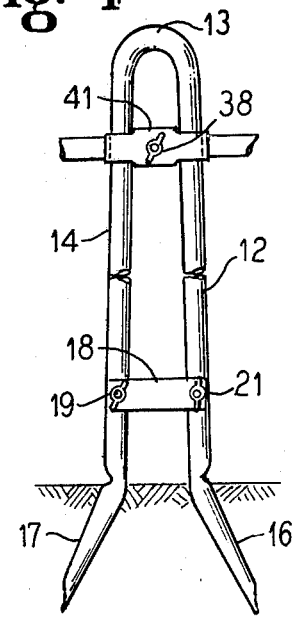
FIG. 4 illustrates the ground supporting member.
Figure 3:
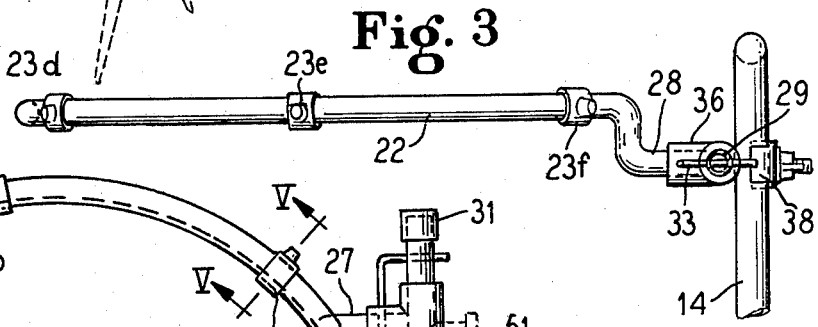
FIG. 3 is a side plan view of the bag holder of the invention.
Figure 2:
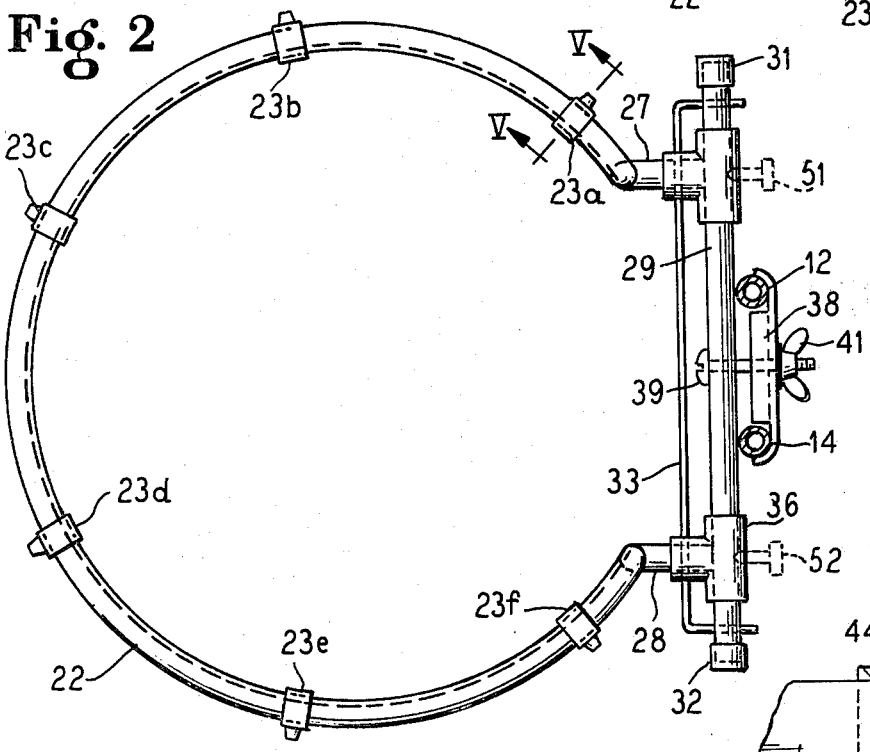
FIG. 2 is a top plan view of the bag holder of the invention.
Figure 5:
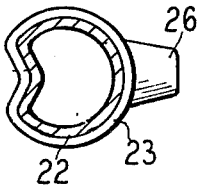
FIG. 5 is a sectional view through line V—V from FIG. 2.

FIG. 1 illustrates the bag holder 10 of the invention which comprises a vertical stand having upright members 12 and 14 joined with an upper U-shape member 13 as shown in FIG. 4 for example and having ground engaging pointed feet 16 and 17 at the lower ends of the members 12 and 14. A lower cross brace 18 which can also be used as a foot stand for inserting the points 16 and 17 into the ground extends transversely of the members 12 and 14 and is connected by set screws 19 and 21 which pass through the members 12 and 14 to hold the member 18 to the members 12 and 14. The set screws such as set screw 21 can be loosened so as to allow cylindrical roll of bags 15 illustrated in FIG. 1 to be inserted over the member 21 after which the foot stand 18 is reconnected to the member 12 as shown in FIG. 4. An adjustable hoop 22 is connected to the upper portion of the members 12 and 14 as, for example, by the use of a transversely extending cylindrical member 29 as shown in FIG. 2 which is attached to the members 12 and 14 by a set screw 39 which passes through an opening in the member 29 and through a brace member 38 which has opposite ends that engage the members 12 and 14. A wing nut 41 can be tightened on set screw 39 so as to clamp the transverse member 29 to the members 12 and 14. A pair of a T-shape members 34 and 36 having opening through which the member 29 extends and are slidably mounted on the member 29. The ends 27 and 28 of the hoop 22 are received in openings in the T-shape members 34 and 36 for supporting the hoop 22. The sliding members 34 and 36 are provided with openings through which a transverse slide guide 33 extends which has opposite ends that wrap around the ends of the member 29 or alternatively may extend through openings formed through the member 29 for that purpose. Plastic cover caps 31 and 32 are mounted on the ends of the transverse member 29 as shown in FIG. 2. A plurality of holding means 23a through 23f are arranged on the hoop 22 in the bag engaging portion and the loop 22 may be indented as shown in sectional view of FIG. 5 so as to prevent the holders 23 from rotating relative to the hoop 22. The holders 23 are formed with prongs 26 which engage the top of the bag to hold it to the hoop.

Figure 6:
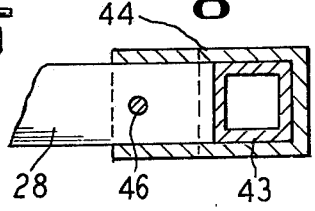
FIG. 6 illustrates a modification of the invention.

FIG. 6 illustrates a modification of the invention wherein the cross-member 29 is made of a rectangular member 43 which is attached by the set screw 39 to the members 12 and 14 and the T-shape members 34 and 36 would be provided with generally square shape openings such as shown by the T-shape member 44 in FIG. 6 and the ends such as the end 28 of the hoop would be inserted into the opening of the member 44 and pinned therein with a pin 46. This would prevent the hoop from drooping or moving out of the horizontal plane.

Alternatively, set screws 51 and 52 could be mounted into threaded openings formed in the T-shape members 34 and 36 and utilized to lock the T-shape members 34 and 36 relative to the transverse member 29 which would eliminate the requirement of the slide member 33 since the set screws 51 and 52 would support the hoop 22 on the cross-member 29 so the hoop would not rotate and the set screw 39 would prevent the member 29 from rotating relative to the upright members 12 and 14.

In use, the reserve bags 15 are mounted on the upright member 12 by loosening the set screw 21 and inserting them about the upright member 12 after which the set screw 21 is replaced. Then the bag holder is inserted into the ground with the foot stand 18 which allows vertical pressure to be applied thereto so that the member will pass into the ground. Then the bag 11 has its open end passed within and over the hoop 22 by adjusting the transverse position of the T-shape members 34 and 36 to the proper size by sliding along the member 33 and/or by loosening the set screws 51 and 52 to adjust the holder to the proper size. Then the upper end 24 is pulled over and down over the outside of the bag 11 so that the upper end 24 engages the holders 23 and the prongs 26 hold the bag firmly. If the bottom of the bag does not engage the ground the wing nut 41 can be loosened so that the transverse member 29 and the hoop 22 can be lowered so that the bottom of the bag will engage the ground. Alternatively, of course, the hoop can be raised by loosening the wing nut 41 and vertically moving the member 29 after which the wing nut 41 is tightened. The bag can then be filled by one person since the opening of the bag is held in the full open position and after the bag is filled, the upper end 24 can be removed from the holding members 23 such that the bag can be removed from the holder 10.

Although the invention has been described with respect to preferred embobiments, it is not to be so limited as changes and modifications may be made therein which are within the full intended scope as defined by the appended claims.

I claim as my invention:

1. A plastic bag holder comprising, an upright support member with a ground engaging portion, a foot rest on said upright support member, an adjustable hoop supported on said upright support adjacent the top thereof, means for changing the diameter of said hoop, said means for changing the diameter of said hoop comprises a transverse bar attached to the upper portion of said upright support member and a pair of T-shaped members slidably mounted on said transverse bar and the opposite ends of said hoop attached to said T-shaped member, and a rod extending parallel of said transverse bar extending through said pair of T-shaped members and with its ends attached to opposite ends of said transverse bar.

2. A plastic bag holder according to claim 1 including a plurality of holding members mounted on said hoop for engaging and locking a plastic bag to said hoop.

3. A plastic bag holder according to claim 1 including a pair of set screws mounted in said T-shaped members for locking them to said transverse bar.

4. A plastic bag holder according to claim 1 wherein said transverse bar is rectangular in cross-section and passes through rectangular openings in said T-shaped members.

5. A plastic bag holder according to claim 1 wherein said transverse bar is round in cross-section.

6. A plastic bag holder according to claim 1 wherein said upright support member is formed of a pair of longitudinal members joined at the top with the lower ends of said longitudinal members formed with points for inserting into the ground.

7. A portable bag holder according to claim 6 including at least one transverse brace mounted between said pair of longitudinal members to form said foot rest.

8. A portable bag holder according to claim 7 wherein at least one end of said brace detachably connected to one of said pair of longitudinal members to allow the storage of bags.

* * * * *